US010486424B2

(12) United States Patent
Kondo et al.

(10) Patent No.: US 10,486,424 B2
(45) Date of Patent: Nov. 26, 2019

(54) LIQUID EJECTION HEAD AND LIQUID EJECTION APPARATUS

(71) Applicant: CANON KABUSHIKI KAISHA, Tokyo (JP)

(72) Inventors: Soji Kondo, Yokohama (JP); Naozumi Nabeshima, Tokyo (JP); Koichi Kubo, Yokohama (JP); Kazuya Yoshii, Yokohama (JP); Noriyasu Nagai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/025,371

(22) Filed: Jul. 2, 2018

(65) Prior Publication Data

US 2019/0009541 A1 Jan. 10, 2019

(30) Foreign Application Priority Data

Jul. 7, 2017 (JP) ..... 2017-133994

(51) Int. Cl.

| | |
|---|---|
| ***B41J 2/155*** | (2006.01) |
| ***B41J 2/175*** | (2006.01) |
| ***B41J 2/045*** | (2006.01) |
| ***B41J 2/14*** | (2006.01) |
| ***B41J 2/21*** | (2006.01) |
| ***B41J 2/18*** | (2006.01) |

(52) U.S. Cl.

CPC ..... *B41J 2/155* (2013.01); *B41J 2/0458* (2013.01); *B41J 2/1404* (2013.01); *B41J 2/14024* (2013.01); *B41J 2/14072* (2013.01); *B41J 2/175* (2013.01); *B41J 2/18* (2013.01); *B41J 2/2103* (2013.01); *B41J 2202/12* (2013.01); *B41J 2202/20* (2013.01)

(58) Field of Classification Search

CPC .... B41J 2/0458; B41J 2/14024; B41J 2/1404; B41J 2/14072; B41J 2/175; B41J 2/18; B41J 2/2103; B41J 2/155

See application file for complete search history.

(56) References Cited

U.S. PATENT DOCUMENTS

| | | | | |
|---|---|---|---|---|
| 6,969,154 | B2 | 11/2005 | Takeuchi et al. | |
| 8,454,140 | B2 | 6/2013 | Kondo | |
| 9,962,937 | B2 | 5/2018 | Okushima et al. | |
| 2017/0197409 | A1 | 7/2017 | Okushima et al. | |
| 2017/0197419 | A1 | 7/2017 | Okushima et al. | |
| 2017/0197439 | A1 | 7/2017 | Okushima et al. | |
| 2017/0274647 | A1 | 9/2017 | Aoki et al. | |
| 2017/0313076 | A1 | 11/2017 | Okushima et al. | |
| 2018/0001623 | A1* | 1/2018 | Nakano | B41J 2/0456 |

(Continued)

FOREIGN PATENT DOCUMENTS

JP 2010-30206 A 2/2010

*Primary Examiner* — Lamson D Nguyen
(74) *Attorney, Agent, or Firm* — Venable LLP

(57) ABSTRACT

A page-wide liquid ejection head detachable from a main body of a liquid ejection apparatus includes a supply connector connected to the main body and adapted to allow passage of a liquid supplied to the liquid ejection head; and a recovery connector connected to the main body and adapted to allow passage of the liquid recovered from the liquid ejection head, wherein the supply connector and the recovery connector are placed at one end in a longitudinal direction of the liquid ejection head.

18 Claims, 15 Drawing Sheets

(56) References Cited

U.S. PATENT DOCUMENTS

| | | | |
|---|---|---|---|
| 2018/0043688 | A1 | 2/2018 | Okushima et al. |
| 2018/0272718 | A1 | 9/2018 | Okushima et al. |
| 2019/0001690 | A1 | 1/2019 | Nagai et al. |
| 2019/0001691 | A1 | 1/2019 | Inada et al. |
| 2019/0001697 | A1 | 1/2019 | Yamada et al. |
| 2019/0009543 | A1 | 1/2019 | Yoshii et al. |
| 2019/0009560 | A1 | 1/2019 | Kubo et al. |

* cited by examiner

LIQUID EJECTION HEAD AND LIQUID EJECTION APPARATUS

BACKGROUND OF THE INVENTION

Field of the Invention

The present disclosure relates to a liquid ejection head and liquid ejection apparatus.

Description of the Related Art

For example, Japanese Patent Application Laid-Open No. 2010-30206 discloses a page-wide liquid ejection head provided with a supply port and outlet port (recovery port) of ink as well as a liquid ejection apparatus equipped with the liquid ejection head. Ink supplied through the supply port is discharged through the outlet port by circulating through the liquid ejection head. Also, the liquid ejection head is connected to a main body of the liquid ejection apparatus via the supply port and outlet port, thereby being configured to be removable from the main body.

Now, in a configuration disclosed in Japanese Patent Application Laid-Open No. 2010-30206, the supply port and outlet port, which serve as connecting part for a liquid between the liquid ejection head and the main body of the liquid ejection apparatus, are placed by being spaced away from each other (placed at opposite ends in a longitudinal direction of the liquid ejection head). Consequently, in the configuration disclosed in Japanese Patent Application Laid-Open No. 2010-30206, in order to take measures against ink leakage from the supply port and outlet port, it is necessary to provide separate ink leakage prevention components or a relatively large prevention component covering both the supply port and outlet port. As a result, with the configuration of Japanese Patent Application Laid-Open No. 2010-30206, the liquid ejection head and main body are likely to grow in size.

SUMMARY OF THE INVENTION

An object of the present disclosure is to provide a liquid ejection head which makes it easy to take measures against liquid leakage from a liquid supply connector and a liquid recovery connector provided on the liquid ejection head.

A liquid ejection head according to the present disclosure is a page-wide liquid ejection head detachable from a main body of a liquid ejection apparatus, the liquid ejection head comprising a supply connector connected to the main body and adapted to allow passage of a liquid supplied to the liquid ejection head; and a recovery connector connected to the main body and adapted to allow passage of the liquid recovered from the liquid ejection head, wherein the supply connector and the recovery connector are placed at one end in a longitudinal direction of the liquid ejection head.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

A liquid ejection apparatus 1000 (see FIG. 1) according to the present embodiment will be described below with reference to the drawings. First, an overall configuration of the liquid ejection apparatus 1000 will be described. Next, an ink circulation pathway (see FIG. 2) will be described. Next, a liquid ejection head 3 (see FIGS. 3A, 3B, 4 and the like) will be described.

<Description of Overal Configuration of Liquid Ejection Apparatus>

Figure 1:
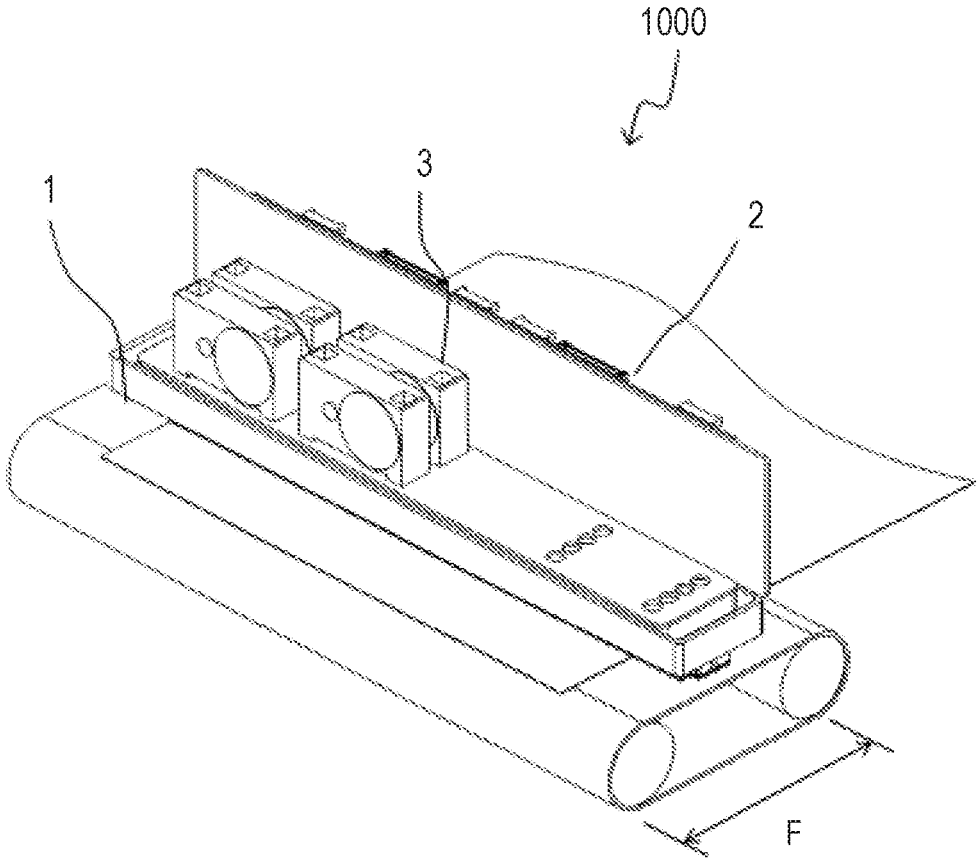
FIG. 1 is a perspective view of part of a liquid ejection apparatus according to the present disclosure.

FIG. 1 shows the liquid ejection apparatus 1000 according to the present embodiment, where the liquid ejection apparatus 1000 records on a recording medium 2 by ejecting ink (an example of a liquid).

The liquid ejection apparatus 1000 is a page-wide liquid ejection apparatus which includes a transport unit 1 adapted to transport the recording medium 2 and a page-wide liquid ejection head 3 placed substantially at right angles to a transport direction of the recording medium 2 and effects continuous recording in a single pass while transporting plural sheets of the recording medium 2 continuously or intermittently. The liquid ejection apparatus 1000 is capable of full color printing using inks (hereinafter referred to as CMYK inks) of C (cyan), M (magenta), Y (yellow) and K (black) colors.

Figure 2:
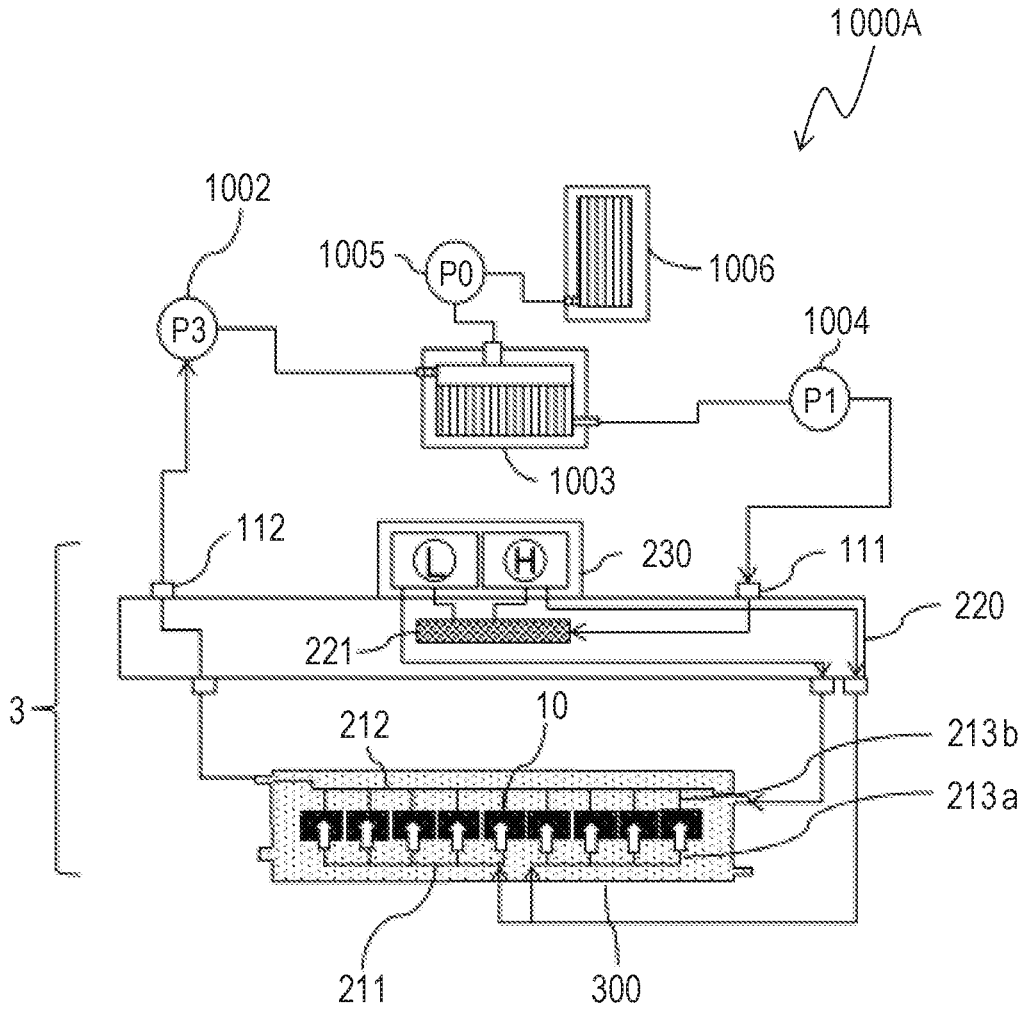
FIG. 2 is a schematic diagram of a circulation pathway of the liquid ejection apparatus according to the present disclosure.

As shown in FIG. 2, the liquid ejection apparatus 1000 includes a liquid supply unit 220, a main tank 1006 and a buffer tank 1003, where the liquid supply unit 220 is a supply path adapted to supply ink to the liquid ejection head 3. According to the present embodiment, the liquid supply unit 220, main tank 1006 and buffer tank 1003 are fluidically connected with one another. The transport unit 1 is designed to transport the recording medium 2 to a position (opposing position) opposed to the liquid ejection head 3. The liquid ejection head 3 is electrically connected with an electric control unit adapted to transmit electric power and an ejection control signal to the liquid ejection head 3. A liquid pathway and electric signal pathway in the liquid ejection head 3 will be described later.

The recording medium 2 used for the liquid ejection apparatus 1000 according to the present embodiment is not limited to cut sheets, and may be continuous roll paper. The liquid ejection head 3 of the liquid ejection apparatus 1000 according to the present embodiment is a head of a type designed to circulate ink stored inside the head as described later. In the liquid ejection apparatus 1000 according to the present embodiment, the liquid ejection head 3 is configured to be detachable from a main body 1000A of the liquid ejection apparatus 1000. Note that although ink is described as an example of a liquid in the present embodiment, a liquid other than ink may be used.

<Description of Ink Circulation Pathway>

Next, the ink circulation pathway according to the present embodiment will be described. FIG. 2 is a schematic diagram showing one form of a circulation pathway applied to the liquid ejection apparatus 1000 according to the present embodiment. As shown in FIG. 2, the liquid ejection head 3 is fluidically connected with a first circulation pump 1002, a buffer tank 1003, a second circulation pump 1004 and the like. Here, although only a pathway through which one of the CMYK inks flows is shown in FIG. 2 for simplicity of explanation, actually circulation pathways for four colors are provided in the liquid ejection head 3 and liquid ejection apparatus body 1000A (hereinafter referred to as the main body 1000A). FIG. 2, which is a schematic diagram for illustrating the ink circulation pathway, describes a partially simplified configuration. For example, in FIG. 2, a supply connector 111 and recovery connector 112 are provided at opposite ends in a longitudinal direction of the liquid ejection head. However, as described later with reference to FIG. 3B and the like, the supply connector 111 and recovery connector 112 according to the present embodiment, are gathered together on one end of the liquid ejection head in the longitudinal direction.

The buffer tank 1003 is a sub-tank connected to the main tank 1006. The buffer tank 1003 is provided with an atmosphere communication hole (not shown) adapted to communicate the inside of the tank with the outside and is capable of discharging air bubbles in the ink to the outside. The buffer tank 1003 is also connected to a replenishment pump 1005. When ink is consumed in the liquid ejection head 3 by being ejected (discharged) through ejection orifices in the liquid ejection head 3 during recording, suction recovery or the like carried out by ejecting ink, the replenishment pump 1005 transfers ink from the main tank 1006 to the buffer tank 1003 to make up for the consumption.

The first circulation pump 1002 has a function to draw ink out of the recovery connector 112 of the liquid ejection head 3 and send the ink to the buffer tank 1003. Here, as the first circulation pump 1002, a positive displacement pump having a quantitative pumping ability is desirable.

When the liquid ejection head 3 is driven, certain amounts of ink are caused to flow through common recovery paths 212 by the first circulation pump 1002. Desirably the flow rate of the ink is set such that temperature differences among recording element substrates 10 in the liquid ejection head 3 will not affect recording image quality.

A negative pressure control unit 230 (an example of a pressure control unit) is provided by being surrounded by pathways linking the second circulation pump 1004 to a liquid ejection unit 300. The negative pressure control unit 230 has a function to operate in such a way as to maintain pressure on a downstream side of the negative pressure control unit 230 (i.e., on the side of the liquid ejection unit 300) at a preset, constant level even if a flow rate of a circulation system fluctuates due to variation in recording duty.

Two pressure-regulating mechanisms (pressure-regulating mechanism H and pressure-regulating mechanism L described later) making up the negative pressure control unit 230 may be of any type as long as the pressure-regulating mechanisms can keep the pressure on the downstream side of the pressure-regulating mechanisms within a predetermined range around a desired set pressure. For example, a mechanism similar to a "pressure-reducing regulator" can be adopted.

The above configuration can curb the effect of water head pressure on the liquid ejection head 3 of the buffer tank 1003, increasing the flexibility of layout of the buffer tank 1003 in the liquid ejection apparatus 1000. The second circulation pump 1004 can be of any type that has a head pressure higher than a predetermined level within a range of an ink circulation flow rate used during operation of the liquid ejection head 3. For example, a turbo pump, positive displacement pump and the like are applicable. More specifically, a diaphragm pump and the like are applicable. Note that instead of the second circulation pump 1004, a water header tank placed, for example, relative to the negative pressure control unit 230 with a certain water head difference is applicable.

As shown in FIG. 2, the negative pressure control unit 230 includes two pressure-regulating mechanisms on which respective control pressures different from each other are set. Of the two pressure-regulating mechanisms, the pressure-regulating mechanism on the relatively higher-pressure side is designated as a pressure-regulating mechanism H (H in FIG. 2) and the pressure-regulating mechanism on the relatively lower-pressure side is designated as a pressure-regulating mechanism L (L in FIG. 2). The pressure-regulating mechanism H and pressure-regulating mechanism L are connected to common supply paths 211 and the common recovery paths 212, respectively, in the liquid ejection unit 300 by passing inside the liquid supply unit 220.

As shown in FIG. 2, the common supply paths 211 and common recovery paths 212 are provided in the liquid ejection unit 300. Individual flow paths 213 (individual supply path 213*a* and individual recovery path 213*b*) are provided by being communicated with respective recording element substrates. Because the individual flow paths 213 are communicated with the common supply paths 211 and common recovery paths 212, part of the ink sent by the first circulation pump 1002 flows from the common supply paths 211 to the common recovery paths 212 (white arrow in FIG. 2) by passing through internal flow paths of recording element substrates 10. The flow is produced because there is a pressure difference between the pressure-regulating mechanism H connected to the common supply path 211 and the pressure-regulating mechanism L connected to the common recovery paths 212 and because the first circulation pump 1002 is connected only to the common recovery paths 212.

Thus, flow of ink passing through the common recovery paths 212 and flow of ink going from the common supply paths 211 to the common recovery paths 212 by passing inside the recording element substrates 10 occur in the liquid ejection unit 300. This allows heat generated in the recording element substrates 10 to be discharged out of the recording element substrates 10 by the ink flowing from the common supply paths 211 to the common recovery paths 212. With the above configuration, during recording by means of the liquid ejection head 3, flows of ink can be generated in the ejection orifices and a pressure chamber not involved in the recording, and thus thickening of the ink in the given sites can be inhibited. Thickened ink as well as foreign matter in the ink can be discharged to the common recovery paths 212.

<Description of Liquid Ejection Head>

Figure 3A:
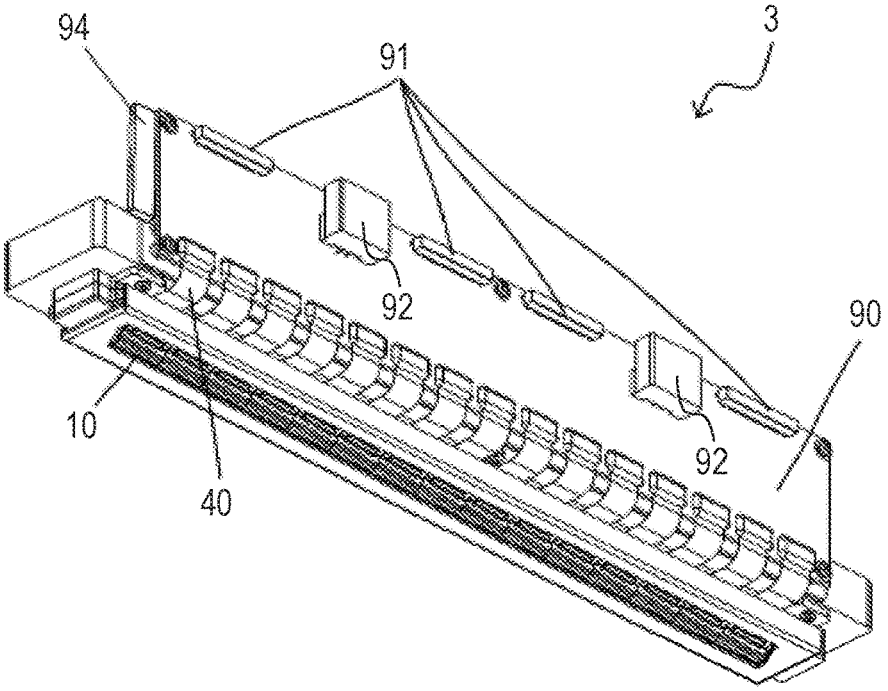
FIGS. 3A and 3B are perspective views of a liquid ejection head according to the present disclosure.
Figure 3B:
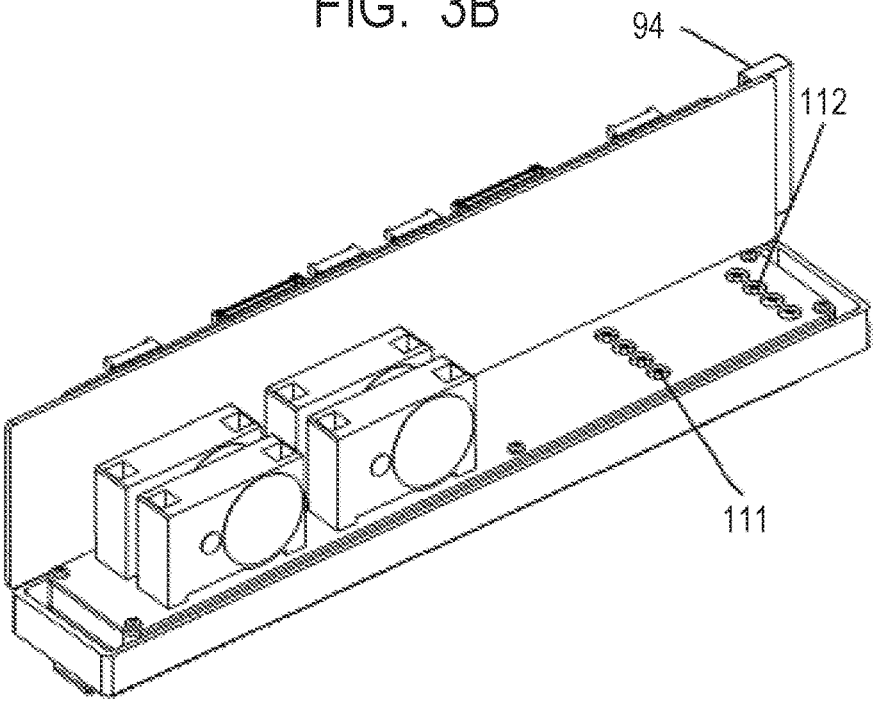

Next, the liquid ejection head 3 according to the present embodiment will be described. FIGS. 3A and 3B are perspective views of the liquid ejection head 3 according to the present embodiment. The liquid ejection head 3 is elongated in shape. It has been stated that the liquid ejection head 3 is placed substantially at right angles to the transport direction of the recording medium 2, and this means that the liquid ejection head 3 is placed with its longitudinal direction oriented substantially at right angles to the transport direction of the recording medium 2. The liquid ejection head 3 according to the present embodiment is a page-wide head in which 15 recording element substrates 10, each capable of ejecting CMYK inks with one recording element substrate 10, are placed in line (in-line arrangement of plural recording element substrates). That is, the liquid ejection head 3 according to the present embodiment is an integral head adapted to eject multi-color inks. As shown in FIG. 3A, the liquid ejection head 3 includes the plural recording element substrates 10, flexible wiring boards 40, signal input terminals 91 and power supply terminals 92. The signal input terminals 91 and power supply terminals 92 are electrically connected with each other via an electric wiring board 90.

The signal input terminals 91 and power supply terminals 92 are electrically connected to a control unit of the liquid ejection apparatus 1000 and are designed to supply electric power needed for an ejection drive signal and ejection, respectively, to the recording element substrates 10. According to the present embodiment, because wiring is concentrated on electric circuitry in the electric wiring board 90, the numbers of signal input terminals 91 and power supply terminals 92 are smaller than the number of recording element substrates 10. This provides the advantage of reducing the number of electrical connection parts needed to be removed when assembling the liquid ejection head 3 onto the liquid ejection apparatus 1000 or replacing the liquid ejection head 3.

The liquid ejection head 3 according to the present embodiment can be connected to the main body 1000A of the liquid ejection apparatus 1000 via the supply connector 111 and recovery connector 112. That is, the liquid ejection head 3 is designed to be replaced by being separated from the main body 1000A via the supply connector 111 and recovery connector 112.

Here, as shown in FIG. 3B, the supply connector 111 and recovery connector 112 are gathered together on the liquid ejection head 3. In the present embodiment, the supply connector 111 and recovery connector 112 are gathered together on one end (one side) of the liquid ejection head 3 in the longitudinal direction, as an example. Note that as shown in FIG. 2, the supply connector 111 and recovery connector 112 connect the liquid supply unit 220 with part of the circulation pathway made up of the first circulation pump 1002, buffer tank 1003, second circulation pump 1004 and the like. There are a plurality of the supply connectors 111 and a plurality of the recovery connectors 112. According to the present embodiment, the plurality of supply connectors 111 are adjacently arranged and clustered together and the plurality of recovery connectors 112 are adjacently arranged and clustered together. With the above configuration, the CMYK inks are supplied from a supply system of the liquid ejection apparatus 1000 to the liquid ejection head 3 and the inks are recovered into the supply system of the liquid ejection apparatus 1000 after passing inside the liquid ejection head 3. That is, the CMYK inks can circulate through a circulation pathway of the liquid ejection apparatus 1000 and circulation pathway of the liquid ejection head 3. Note that an electrical connector 94 (an example of an electrical connection part; see FIG. 3B) electrically connects the liquid ejection head and liquid ejection apparatus with each other.

Figure 4:
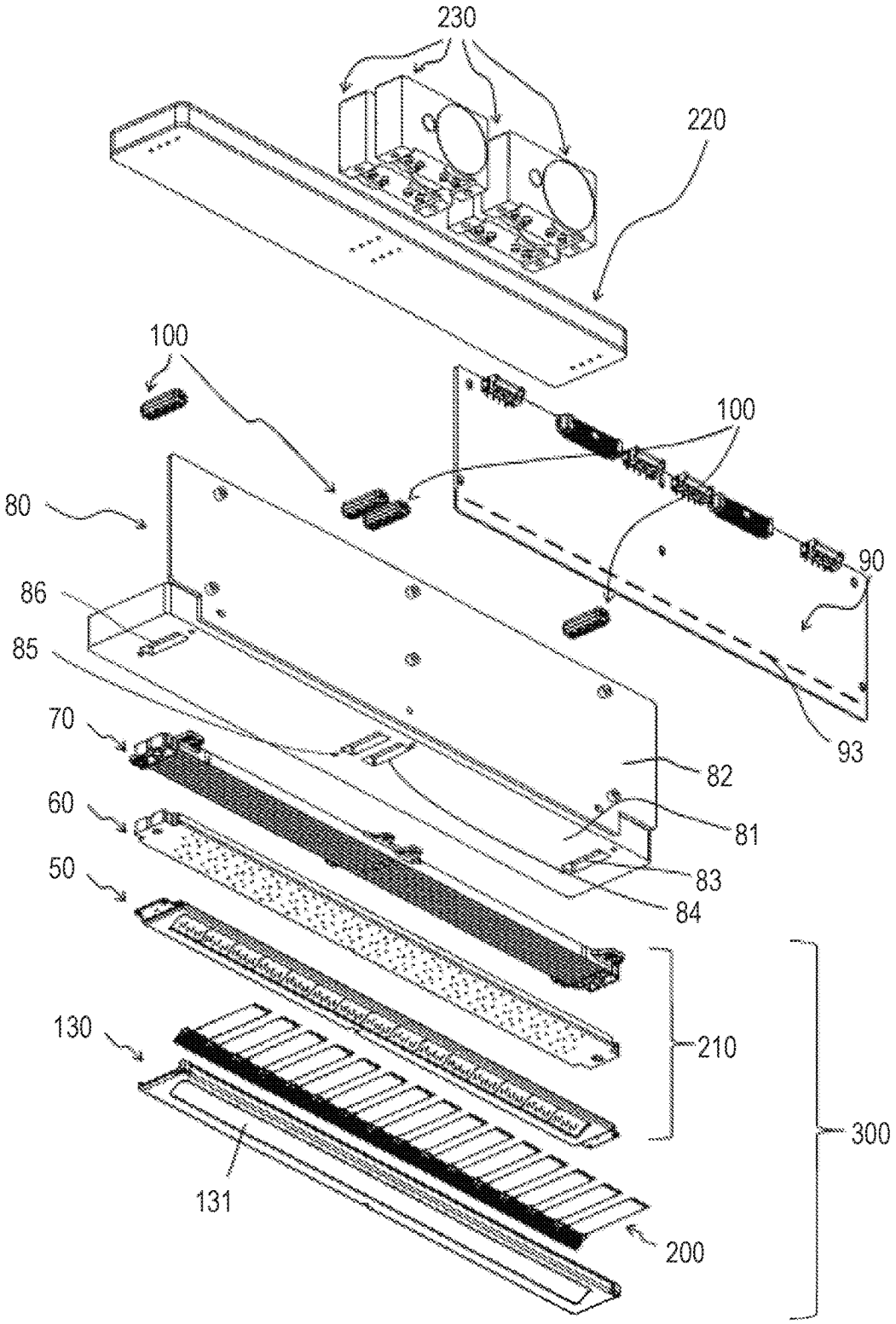
FIG. 4 is an exploded perspective view of the liquid ejection head according to the present disclosure.

FIG. 4 shows an exploded perspective view of components (or units) making up the liquid ejection head 3. As shown in FIG. 4, the liquid ejection unit 300, liquid supply unit 220 and electric wiring board 90 are mounted in a casing 80.

Although not illustrated in FIG. 4, the supply connectors 111 and recovery connectors 112 described with reference to FIG. 3B are provided on the liquid supply unit 220. Although not illustrated in FIG. 4, filters 221 (see FIG. 2) for respective colors are provided inside the liquid supply unit 220 by being communicated with openings in the supply connectors 111 to remove foreign matter in the supplied inks.

The inks passing through the filters 221 are supplied to the color-by-color negative pressure control units 230 placed on the liquid supply unit 220. The negative pressure control units 230 are made up of pressure-regulating mechanisms for the respective colors. By the action of valves, springs, and the like provided inside, the negative pressure control units 230 for the respective colors can greatly decrease pressure loss changes occurring in the supply system as a result of fluctuations in ink flow rates and can stabilize pressure changes on the downstream side (i.e., on the side of the liquid ejection unit 300) within a predetermined range.

The negative pressure control units 230 for the respective colors incorporate two pressure-regulating mechanisms H and L (see FIG. 2), which are set to different control pressures, and the negative pressure control units 230 are communicated with one another via the common supply paths 211 in the liquid ejection unit 300 on the H side, and via the common recovery paths 212 and liquid supply unit 220 on the L side.

The casing 80 includes a liquid ejection unit support member 81 and an electric wiring board support unit 82. Also, the casing 80 supports the liquid ejection unit 300 and electric wiring board 90 and secures rigidity of the liquid ejection head 3. The electric wiring board support unit 82 is intended to support the electric wiring board 90 and is fixedly screwed to the liquid ejection unit support member 81. The liquid ejection unit support member 81 is provided with openings 83, 84, 85 and 86 into which rubber joints 100 are inserted. The ink supplied from the liquid supply unit 220 is led to a third flow path member 70 of the liquid ejection unit 300 via the rubber joints.

The liquid ejection unit 300 includes plural ejection modules 200 and a flow path member 210, and a cover member 130 is mounted on a surface of the liquid ejection unit 300 on the side of the recording medium 2. Here, as shown in FIG. 4, the cover member 130 has a frame-shaped surface in which an elongated opening 131 is formed and the recording element substrates 10 and a sealant 110 (see FIG. 8B) included in the ejection modules 200 are exposed from the opening 131. A frame around the opening 131 functions as an abutting surface of a cap member (not shown) adapted to cap the liquid ejection head 3 during standby for recording.

Next, a configuration of the flow path member 210 included in the liquid ejection unit 300 will be described. As shown in FIG. 4, the flow path member 210 is a stack of a first flow path member 50, second flow path member 60 and third flow path member 70. The flow path member 210 has a function to distribute the ink supplied from the liquid supply unit 220 to the ejection modules 200 and return the ink recirculating from the ejection modules 200 to the liquid supply unit 220. The flow path member 210 is fixedly screwed to the liquid ejection unit support member 81.

Figure 5A:
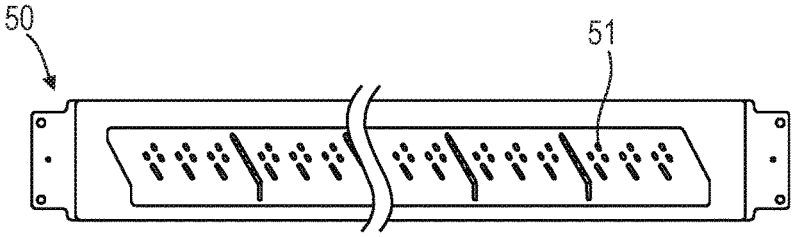
FIGS. 5A, 5B, 5C, 5D, 5E and 5F are schematic diagrams showing a front side and back side of a first flow path member, a front side and back side of a second flow path member, and a front side and back side of a third flow path member in the present disclosure.
Figure 5B:
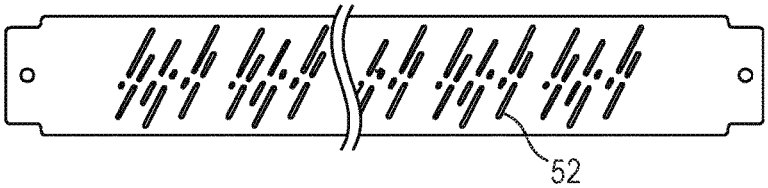
Figure 5C:
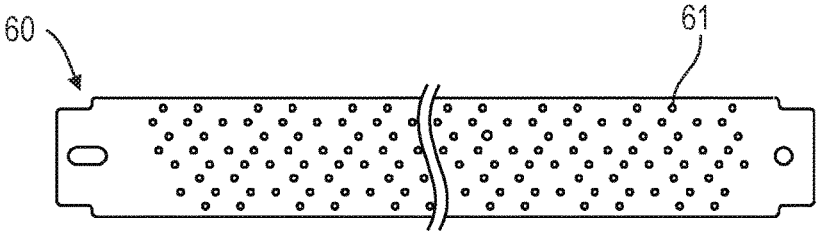
Figure 5D:
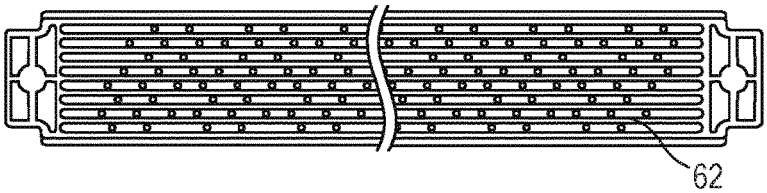
Figure 5E:
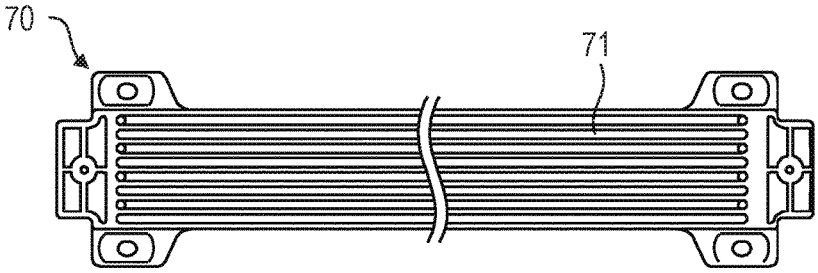
Figure 5F:
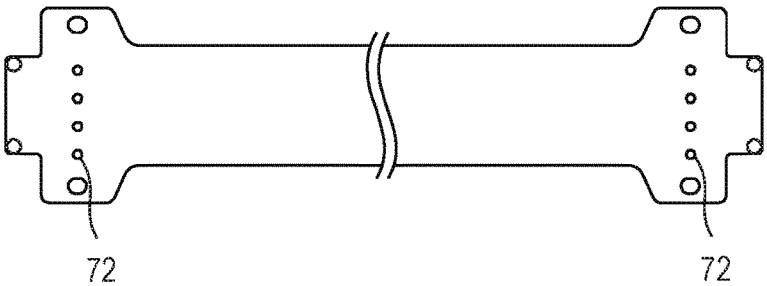

FIGS. 5A to 5F are diagrams showing front sides and back sides of the first to third flow path members 50, 60 and 70. FIG. 5A shows a surface on that side of the first flow path member 50 on which the ejection modules 200 are mounted, and FIG. 5F shows a surface on that side of the third flow path member 70 which abuts the liquid ejection unit support member 81. The first flow path member 50 and second flow path member 60 are joined together in such a way that respective abutting surfaces (FIGS. 5B and 5C) of the flow path members will be opposed to each other. The second flow path member 60 and third flow path member 70 are joined together in such a way that respective abutting surfaces (FIGS. 5D and 5E) of the flow path members will be opposed to each other. As the second flow path member 60 and third flow path member 70 are joined together, eight common flow paths extending in the longitudinal direction of the flow path members are formed by common flow path grooves 62 and common flow path grooves 71 formed in the respective flow path members.

Figure 6:
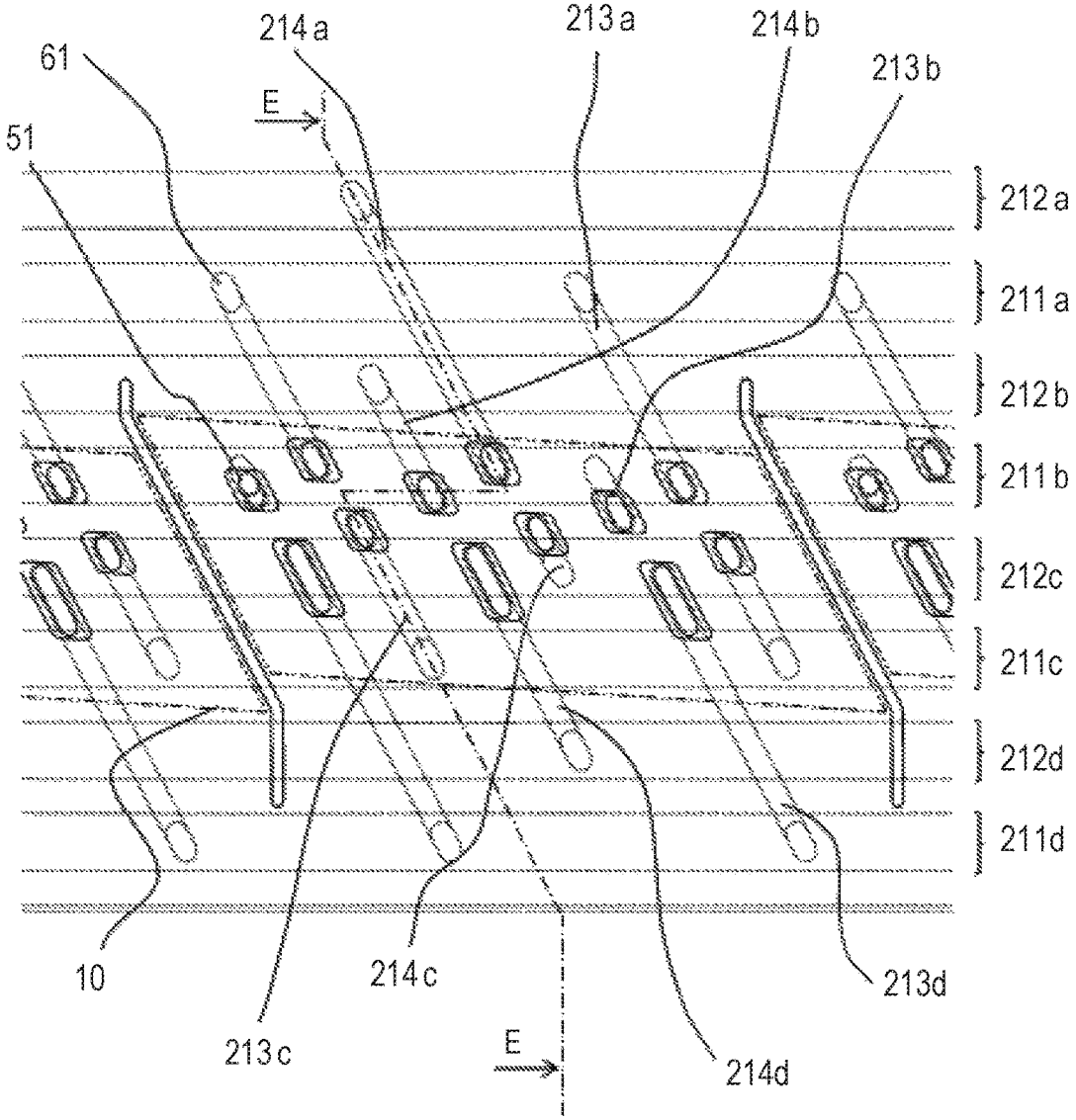
FIG. 6 is a see-through view showing a flow path connection relationship between the first to third flow path members and ejection modules according to the present disclosure.

With the above configuration, a set of the common supply path 211 and common recovery path 212 for each color is formed in the flow path member 210 (see FIG. 6). Communication holes 72 in the third flow path member 70 are communicated with holes in the rubber joints 100 and fluidically communicated with the liquid supply unit 220. Plural communication holes 61 are formed in a bottom face of the second flow path member 60 under the common flow path grooves 62 and communicated with one end of individual flow path grooves 52 in the first flow path member 50. Communication holes 51 are formed at another end of the individual flow path grooves 52 in the first flow path member 50 and fluidically communicated with the plural ejection modules 200 via the communication holes 51. The individual flow path grooves 52 allow flow paths to be gathered together on a center side of the flow path members. Desirably the first to third flow path members 50, 60 and 70 have corrosion resistance to ink and are made of a material with a low coefficient of linear expansion.

Next, a connection relationship among flow paths in the flow path member 210 will be described with reference to FIG. 6. FIG. 6 is a partially enlarged see-through view of the flow paths in the flow path member 210 formed by joining together the first to third flow path members 50, 60 and 70 as viewed from that side of the first flow path member 50 on which the ejection modules 200 are mounted.

Color-by-color common supply paths 211 (211*a*, 211*b*, 211*c* and 211*d*) and common recovery paths 212 (212*a*, 212*b*, 212*c* and 212*d*) are provided in the flow path member 210, extending in the longitudinal direction of the liquid ejection head 3. The common supply paths 211 for the respective colors are connected via the communication holes 61 with plural individual supply paths (213*a*, 213*b*, 213*c* and 213*d*) formed by the individual flow path grooves 52. The common recovery paths 212 for the respective colors are connected via the communication holes 61 with plural individual recovery paths (214*a*, 214*b*, 214*c* and 214*d*) formed by the individual flow path grooves 52.

With the above configuration, the liquid ejection head 3 according to the present embodiment allows the ink to be gathered together on the recording element substrate 10 located in central part of the flow path members from the common supply paths 211 via the individual supply paths 213. The liquid ejection head 3 according to the present embodiment can recover the ink into the common recovery paths 212 from the recording element substrates 10 via the individual recovery paths 214.

Figure 7:
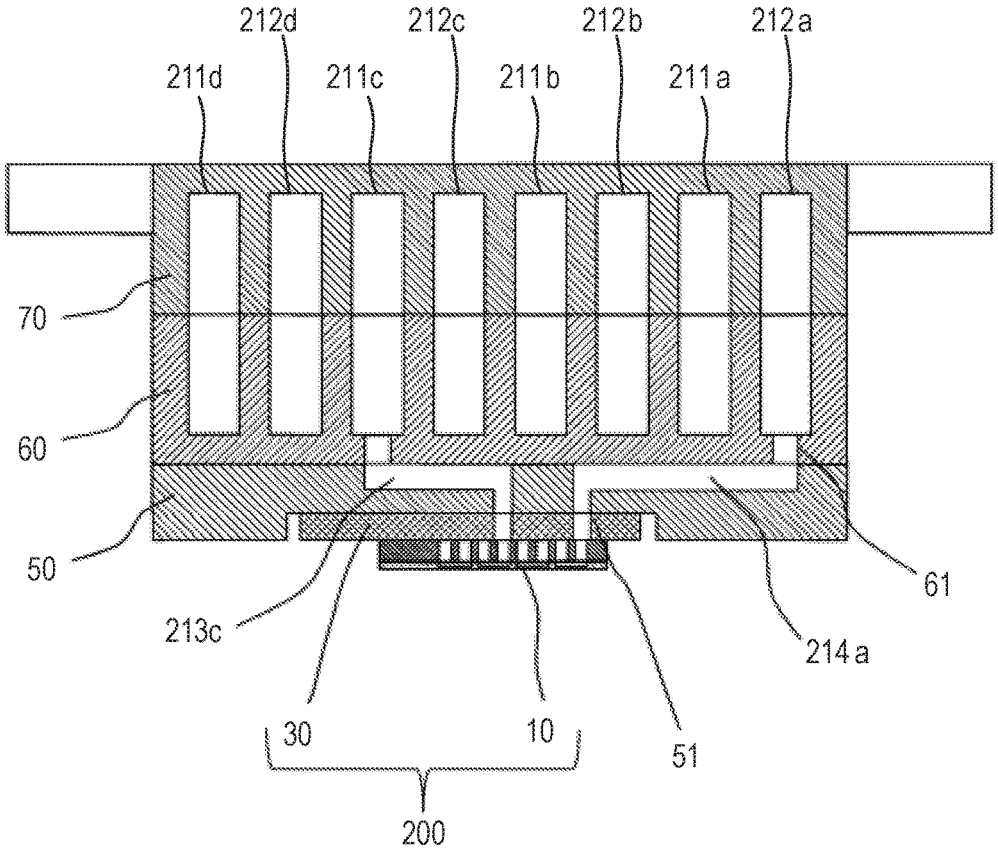
FIG. 7 is a sectional view taken along line E-E of FIG. 6.

FIG. 7 is a sectional view of the liquid ejection head 3 taken along line E-E of FIG. 6. Of all the individual recovery paths, only the individual recovery paths 214*a* and 214*c* are illustrated in FIG. 7. The individual recovery paths 214*a* and 214*c* are communicated with the ejection modules 200 through the communication holes 51. Although only the individual recovery paths 214*a* and 214*c* are illustrated in FIG. 7, in another section, the individual supply paths 213 and the ejection modules 200 are communicated with each other as shown in FIG. 6 (not shown in FIG. 7). Flow paths used to supply ink from the first flow path member 50 to the recording elements 15 (see FIG. 9B) provided on the recording element substrate 10 and flow paths used to recover (recirculate) part or all of the ink supplied to the recording element 15 into the first flow path member 50 are formed in the support member 30 and recording element substrate 10 included in each ejection module 200. Here, the common supply paths 211 for the respective colors are connected with the corresponding negative pressure control units 230 (pressure-regulating mechanisms H) on a high-pressure side via the liquid supply unit 220 and the common recovery paths 212 are connected with the negative pressure control units 230 (pressure-regulating mechanisms L) on the low-pressure side via the liquid supply unit 220. In the present embodiment, a pressure difference is provided between the negative pressure control units 230 on the high-pressure side and the negative pressure control units 230 on the low-pressure side, and the first circulation pump 1002 is connected only to the common recovery paths 212.

With the above configuration, in the liquid ejection head 3 according to the present embodiment, as shown in FIGS. 6 and 7, flows of color inks occur by passing through the common supply paths 211, individual supply path 213*a*, recording element substrates 10, individual recovery path 213*b* and common recovery paths 212 in the order mentioned.

<Description of Ejection Module>

Figure 8A:
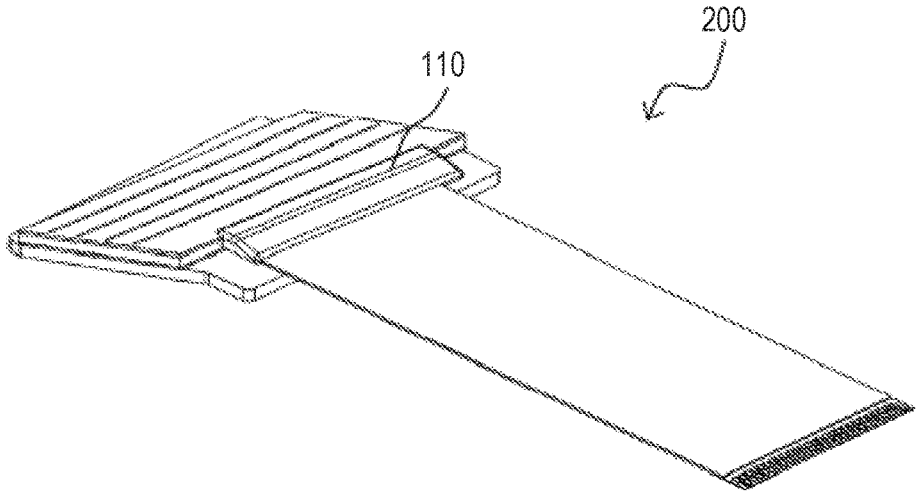
FIGS. 8A and 8B are schematic diagrams showing the ejection module according to the present disclosure.
Figure 8B:
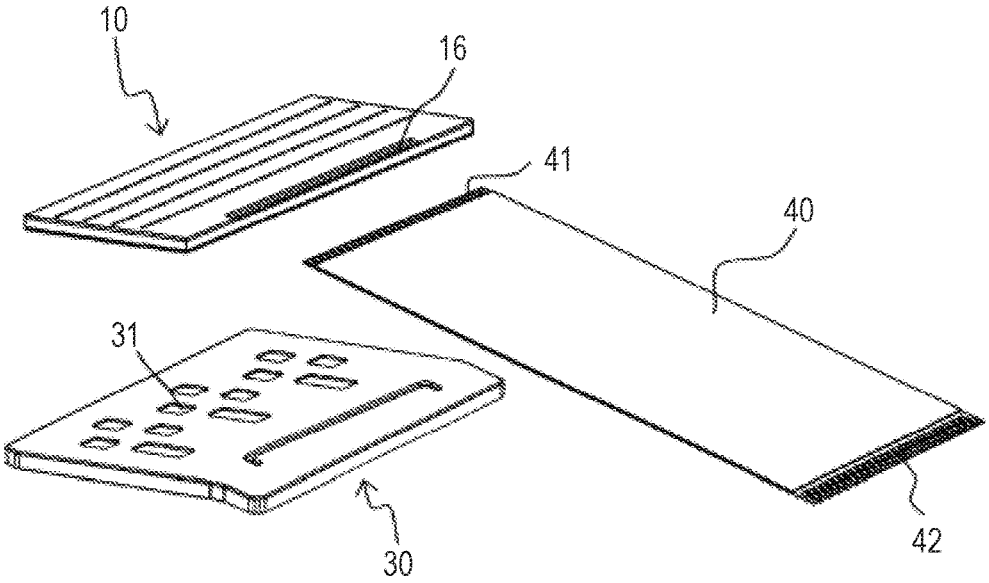

FIG. 8A shows a perspective view of one ejection module 200 and 8B shows an exploded view of FIG. 8A. In a method for producing the ejection module 200 the recording element substrate 10 and flexible wiring board 40 are bonded to the support member 30 in which liquid communication holes 31 are provided in advance. Next, a terminal 16 on the recording element substrate 10 and a terminal 41 on the flexible wiring board 40 are electrically connected by wire bonding. Next, the wire-bonded part (electrical connection part) is sealed by being covered with the sealant 110. As a result, the recording element substrate 10 on the flexible wiring board 40 and a terminal 42 on the opposite side are electrically connected with a connection terminal 93 (see FIG. 4) on the electric wiring board 90.

<Description of Recording Element Substrate>

Figure 9A:
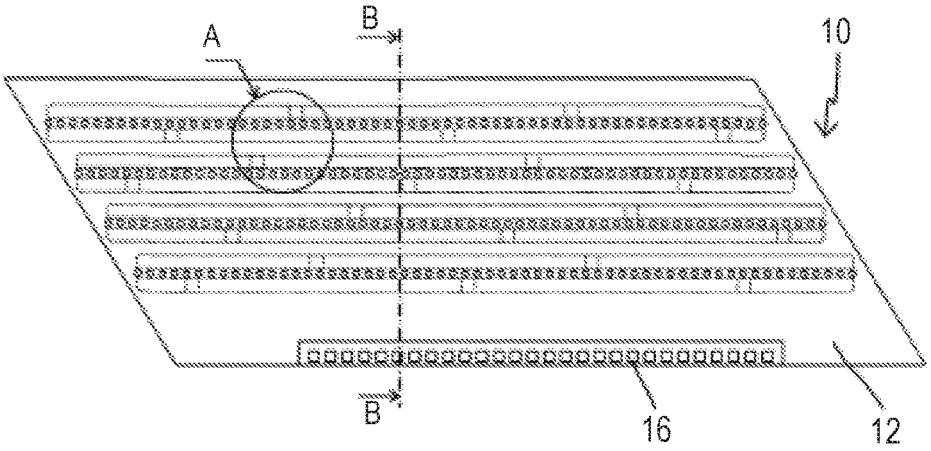
FIGS. 9A, 9B and 9C are schematic diagrams showing a recording element substrate according to the present disclosure.
Figure 9B:
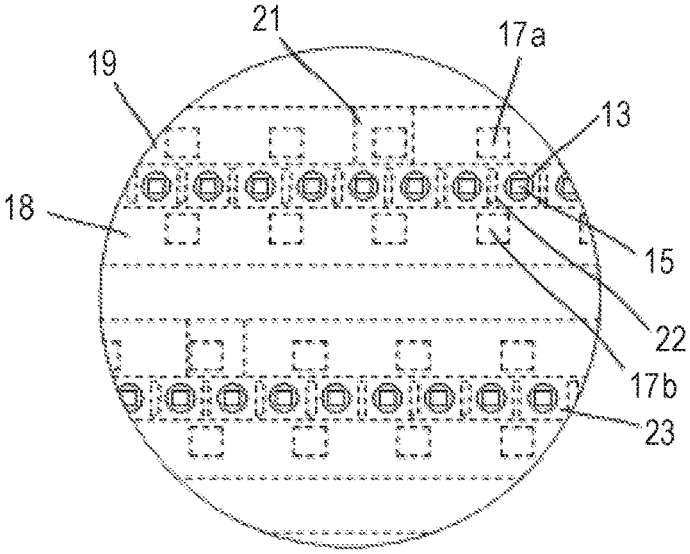
Figure 9C:
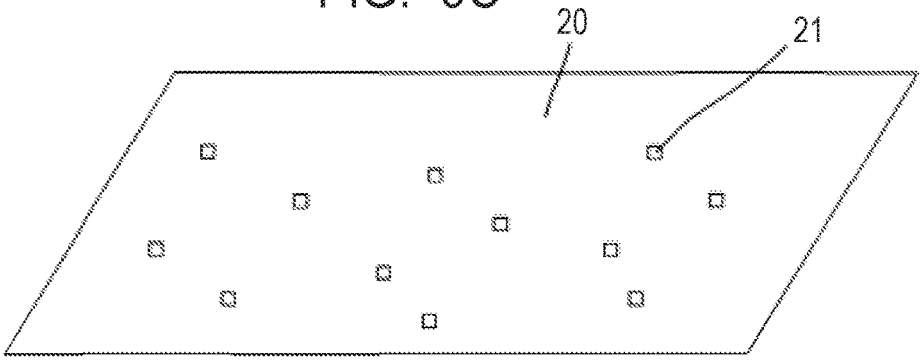

Next, a configuration of the recording element substrate 10 according to the present embodiment will be described. FIG. 9A is a plan view of a surface on that side of the recording element substrate 10 on which ejection orifices 13 are formed, FIG. 9B is an enlarged view of the part indicated by arrow A in FIG. 9A, and FIG. 9C shows a back side of FIG. 9A. As shown in FIG. 9A, four ejection orifice rows corresponding to ink colors are formed in an ejection orifice forming member 12 of each recording element substrate 10. Hereinafter, the direction in which the ejection orifice rows with plural ejection orifices 13 arranged therein extend will be referred to as an "ejection orifice row direction."

As shown in FIG. 9B, as heat-generating elements adapted to foam the ink by heat, recording elements 15 are placed at those positions of the recording element substrate 10 which correspond to the ejection orifices 13. The recording elements 15 are provided in pressure chambers 23 separated by partition walls 22.

The recording elements 15 are electrically connected to the terminal 16 of FIG. 9A via electric wiring (not shown) provided on the recording element substrate 10. The recording elements 15 are designed to generate heat and boil the ink based on a pulse signal received from a control circuit of the liquid ejection apparatus 1000 through the electric wiring board 90 (see FIG. 4) and flexible wiring board 40 (see FIG. 8B). The ink is designed to be ejected through the ejection orifices 13 by the force of foaming resulting from the boiling.

As shown in FIG. 9B, a liquid supply path 18 extends on one side along each ejection orifice row and a liquid recovery path 19 extends on another side. The liquid supply path 18 and liquid recovery path 19 are flow paths extending in the ejection orifice row direction on the recording element substrate 10 and are communicated with the ejection orifices 13 via supply ports 17*a* and recovery ports 17*b*, respectively.

Figure 10:
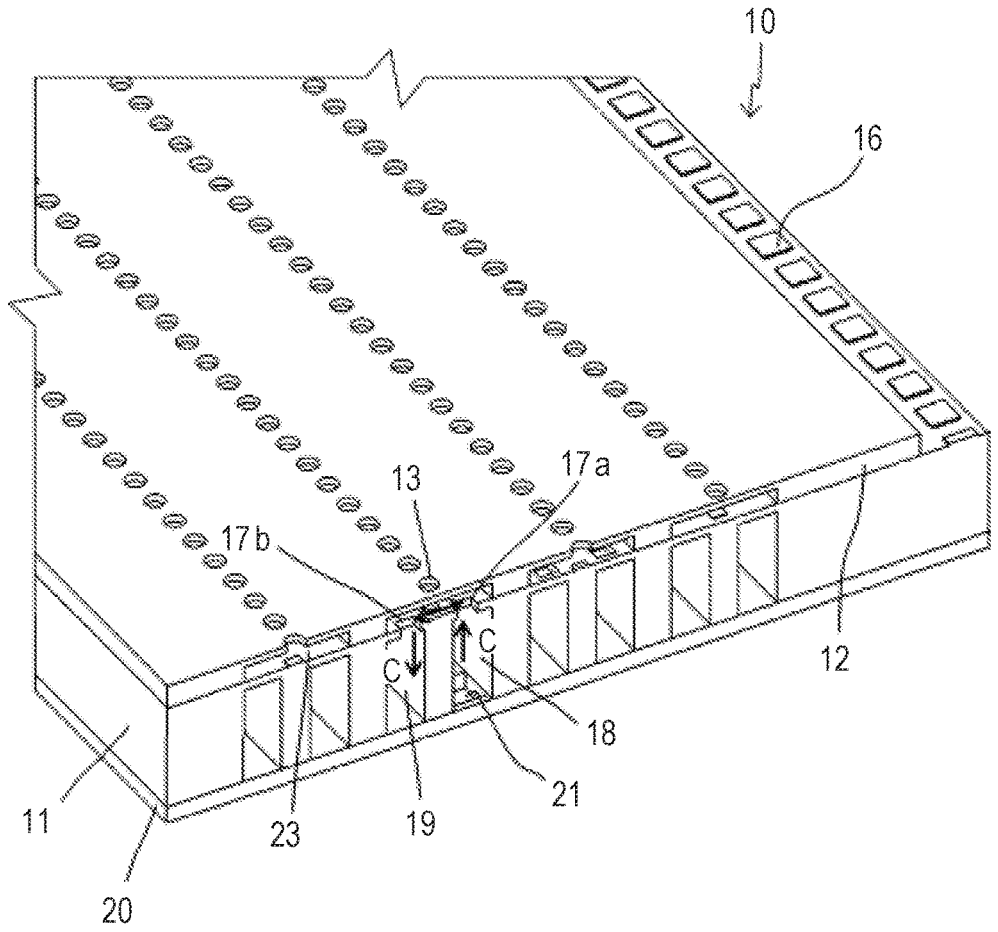
FIG. 10 is a perspective view of a section taken along line B-B in FIG. 9A.

As shown in FIGS. 9C and 10, a sheet-like lid member 20 is stacked on the recording element substrate 10 on the side opposite the side on which the ejection orifices 13 are formed. Plural openings 21 are provided in the lid member 20 by being communicated with the liquid supply paths 18 and liquid recovery paths 19 described later. In the present embodiment, two openings 21 per liquid supply path 18 are provided in the lid member 20 and one opening 21 per liquid recovery path 19 is provided in the lid member 20. As shown in FIG. 9B, the openings 21 are communicated, respectively, with the plural communication holes 51 shown in FIG. 5A.

As shown in FIG. 10, the lid member 20 functions as a lid which forms part of walls of the liquid supply paths 18 and liquid recovery paths 19 formed on a substrate 11 of the recording element substrate 10. Desirably the lid member 20 has sufficient corrosion resistance to ink, and from the perspective of preventing color mixture, the openings 21 are shaped and positioned with high accuracy.

Next, the flow of ink in the recording element substrate 10 will be described. FIG. 10 is a perspective view showing a section of the recording element substrate 10 and lid member 20 taken along line B-B in FIG. 9A. The recording element substrate 10 is formed by stacking the ejection orifice forming member 12 formed of a photosensitive resin on the substrate 11 formed of Si. The lid member 20 is bonded to the back side of the substrate 11.

Here, the recording elements 15 are formed on one side of the substrate 11 (see FIG. 9B), and grooves configured to make up the liquid supply paths 18 and liquid recovery paths 19 extending along the ejection orifice rows are formed on the back side. The liquid supply paths 18 and liquid recovery paths 19 formed by the substrate 11 and lid member 20 are connected, respectively, to the common supply paths 211 and common recovery paths 212 in the flow path member 210, creating a differential pressure between the liquid supply paths 18 and liquid recovery paths 19. In the pressure chambers 23 provided with ejection orifices 13 which do not perform ejection operation while other ejection orifices 13 are performing ejection operation, the ink in the liquid supply paths 18 is caused by the differential pressure to flow to the liquid recovery paths 19 by passing through the supply ports 17*a*, pressure chambers 23 and recovery ports 17*b* (see arrow C in FIG. 10). This flow allows thickened ink produced by evaporation from the ejection orifices 13 not performing ejection operation as well as air bubbles and foreign matter to be recovered into the liquid recovery paths 19. Consequently, thickening of the ink in the ejection orifices 13 and pressure chambers 23 can be inhibited.

The ink recovered into the liquid recovery paths 19 is recovered by the communication holes 51 in the flow path member 210, individual recovery paths 214, and common recovery paths 212 in this order through the openings 21 in the lid member 20 and the liquid communication holes 31 in the support member 30 (see FIG. 8B) and finally flows to a supply pathway in the liquid ejection apparatus 1000. The ink supplied from the main body 1000A of the liquid ejection apparatus 1000 to the liquid ejection head 3 is supplied and recovered by moving in the following order. That is, first, the ink flows into the liquid ejection head 3 from the supply connectors 111 of the liquid supply unit 220 and is supplied to the rubber joints 100, communication holes 72, common flow path grooves 71, common flow path grooves 62, communication holes 61, individual flow path grooves 52, and communication holes 51 in this order. Next, the ink is supplied to the pressure chambers 23 by flowing through the liquid communication holes 31 in the support member 30, openings 21, liquid supply paths 18, and supply ports 17*a* in this order. Here, that part of the ink supplied to the pressure chambers 23 which is not ejected through the ejection orifices 13 flows through the recovery ports 17*b*, liquid recovery paths 19, openings 21, and liquid communication holes 31 in this order. Next, the ink flows through the communication holes 51, individual flow path grooves 52, communication holes 61, common flow path grooves 62, common flow path grooves 71, communication holes 72, and rubber joints 100 in this order. As a result, the ink flows out of the liquid ejection head 3 through the recovery connectors 112 provided in the liquid supply unit 220.

Thus, in the circulation pathway shown in FIG. 2, the liquid flowing in through the supply connectors 111 passes through the negative pressure control units 230 and is then supplied to the rubber joints 100.

<Description of Positional Relationship between Recording Element Substrates>

Figure 11:
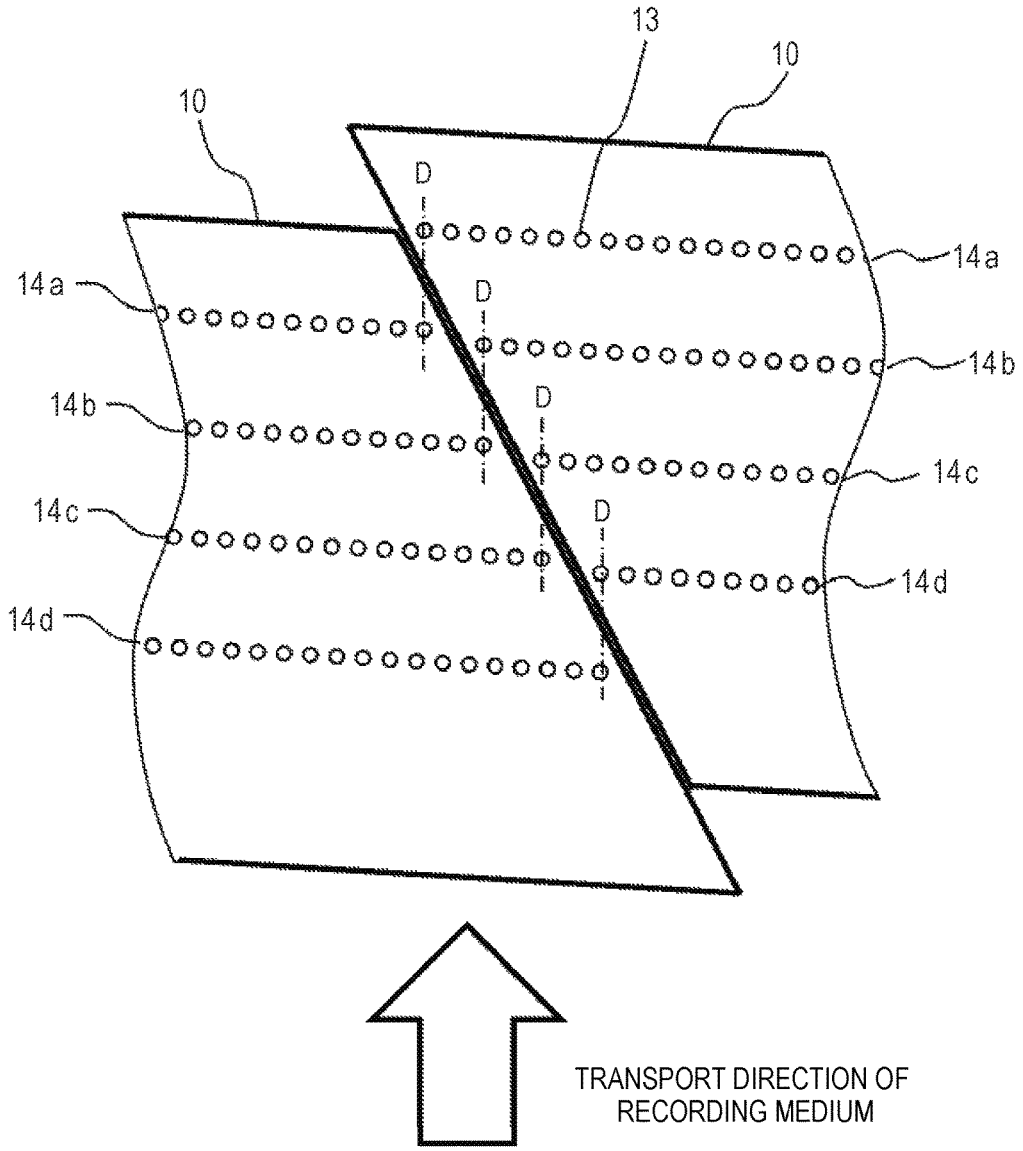
FIG. 11 is a plan view showing adjoining portions of the recording element substrates according to the present disclosure.

FIG. 11 is a partially enlarged plan view showing adjoining portions of two recording element substrates 10 in two adjacent ejection modules. Note that according to the present embodiment, the recording element substrates 10 have a substantially parallelogram shape as shown in FIG. 9A.

As shown in FIG. 11, the ejection orifice rows 14*a* to 14*d* of each recording element substrate 10 with the ejection orifices 13 arranged therein are placed at a certain angle to the transport direction of the recording medium 2. The adjoining portions of the recording element substrates 10 are butted together such that each of the corresponding pairs of the ejection orifice rows 14*a* to 14*d* in the two recording element substrates 10 will overlap each other in at least one ejection orifice 13 in the transport direction of the recording medium 2. In the present embodiment, as shown in FIG. 11, the two ejection orifices 13 on each line D overlap each other. With this arrangement, even if the recording element substrates 10 deviate from their set positions, black streaks and print dropouts in a recorded image can be made less noticeable through drive control of the overlapping ejection orifices 13.

According to the present embodiment, the plural recording element substrates 10 are placed in line rather than in a staggered manner (see FIGS. 3A, 4, 11 and the like). Consequently, according to the present embodiment, measures can be taken against black streaks and print dropouts at a seam between the recording element substrates 10 while keeping down the length of the liquid ejection head 3 in the transport direction of the recording medium 2.

Note that although in the present embodiment, the principal plane of the recording element substrate 10 has a substantially parallelogram shape, the present disclosure is not limited to this, and the recording element substrate 10 may have rectangle, trapezoid, or other shape.

<Detailed Description of Liquid Supply/Recovery Connector>

Next, the supply connectors 111 and recovery connectors 112 (collectively referred to as liquid supply/recovery connectors) according to the present embodiment will be described with reference to drawings.

Figure 12A:
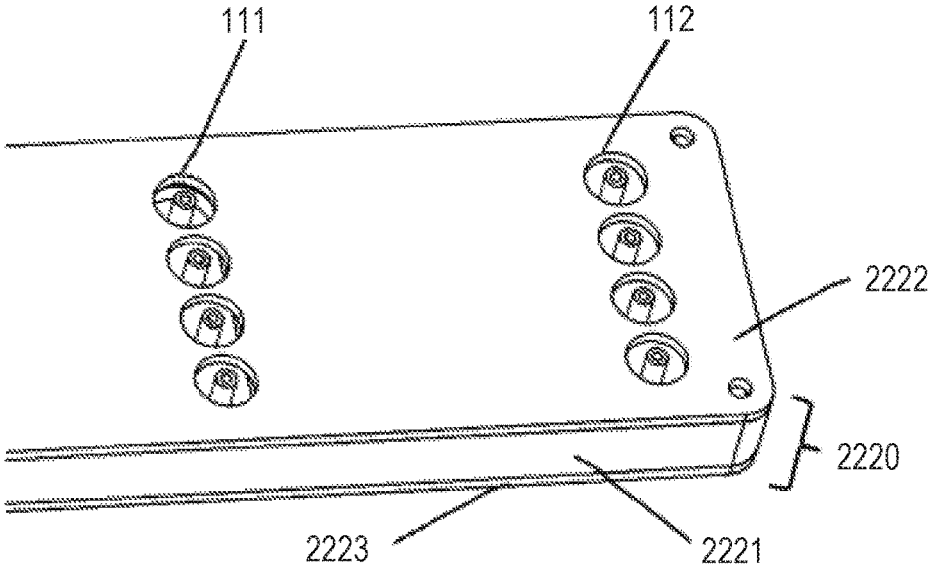
FIGS. 12A and 12B are perspective views of a liquid supply/recovery connector according to the present disclosure.

FIG. 12A is an enlarged view of the supply connectors 111 and recovery connectors 112 provided in the liquid supply unit 220 and their surroundings. As shown in FIG. 12A, the supply connectors 111 and recovery connectors 112 are gathered together on one end of the liquid supply unit 220.

Ink higher in pressure than atmospheric pressure is designed to be supplied to the supply connectors 111 from the main body 1000A of the liquid ejection apparatus 1000. Ink lower in pressure than atmospheric pressure is designed to be supplied to the recovery connectors 112 from the liquid ejection head 3 and thereby recovered into the main body 1000A.

The supply connectors 111 are plural supply pipes 2231 (e.g., four pipes corresponding to the CMYK inks). The four supply pipes 2231 are arranged in line along a lateral direction of the liquid supply unit 220. Viewed from another angle, the four supply pipes 2231 are placed close to one end of the liquid ejection head 3 in the longitudinal direction. By being joined to connection parts provided on the side of the main body 1000A, the supply pipes 2231 are communicated with flow paths in the main body 1000A of the liquid ejection apparatus 1000. The inks passing inside the supply pipes 2231 are supplied to the negative pressure control units 230 by passing through the filters 221 provided downstream of a liquid supply member 2220.

The recovery connectors 112 are plural recovery pipes 2232 (e.g., four pipes corresponding to the CMYK inks). The four recovery pipes 2232 are arranged in line along a lateral direction of the liquid supply unit 220. Viewed from another angle, the four recovery pipes 2232 are placed close to one end of the liquid ejection head 3 (however, at locations different from the locations of the supply connectors 111) in the longitudinal direction. By being joined to connection parts provided on the side of the main body 1000A, the recovery pipes 2232 are communicated with flow paths in the main body 1000A of the liquid ejection apparatus 1000. The ink discharged from individual recovery paths 213*b* of the liquid supply unit 220 is recovered into the main body 1000A of the liquid ejection apparatus 1000 by passing through the recovery pipes 2232.

With the above configuration, as the supply connectors 111 and recovery connectors 112 are gathered together on part of the liquid ejection head 3, it is easy to take measures (e.g., leakage detection measures) against ink leakage. Consequently, the liquid ejection head 3 according to the present embodiment can be removed easily from the main body 1000A for replacement and can be downsized. In particular, according to the present embodiment, the supply connectors 111 and recovery connectors 112 differing in the pressure of the ink flowing therethrough can be placed close to each other. Thus, the present embodiment makes it easier to take measures (e.g., leakage detection measures) against ink leakage.

The supply pipes 2231 and recovery pipes 2232 may be mold members molded integrally with an intermediate plate. Alternatively, the supply pipes 2231 and recovery pipes 2232 may be formed by assembling separate pipes onto an intermediate plate.

According to the present embodiment, the number of supply pipes 2231 (and the number of recovery pipes 2232) is four to match the number of ink colors, but does not have to be four as long as the number matches the number of ink colors (and may be less than four or more than four depending on the number of ink colors).

The supply pipes 2231 (and the recovery pipes 2232) may be arranged along the longitudinal direction of the liquid ejection head 3 rather than along the lateral direction. Also, the supply pipes 2231 (and the recovery pipes 2232) may be arranged in a staggered manner rather than in line.

Figure 12B:
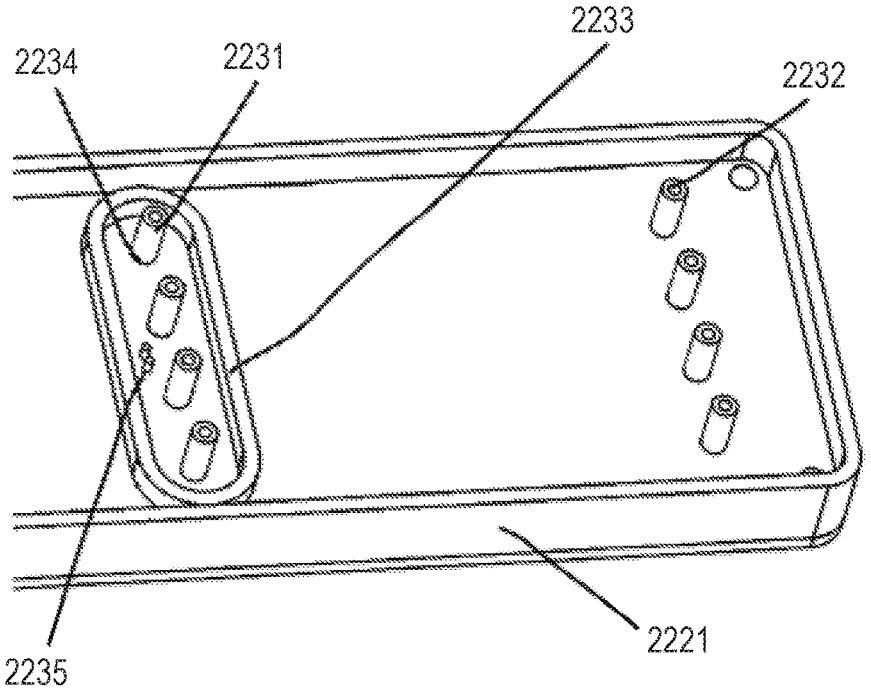

FIG. 12B is a perspective view of the liquid supply/recovery connectors with an upper lid member 2222 (see FIG. 12A) excluded (removed). As shown in FIG. 12B, all the supply pipes 2231 protrude from a plane. Also, roots or bases 2234 of the supply pipes 2231 are surrounded by a partition wall 2233 (an example of a peripheral wall) protruding from a plane. Detection pins 2235 (an example of a detection unit) are provided in the part surrounded by the partition wall 2233.

With the above configuration, if ink leaks from the supply connectors 111, ink is accumulated inside the partition wall 2233, and the ink leakage can be detected by the detection pins 2235 provided inside the partition wall 2233. Also, as the supply pipes 2231 are surrounded by the partition wall 2233, the leaking ink is accumulated around the supply pipes 2231 without spreading. As a result, the present embodiment has high leakage detection accuracy.

Figure 13:
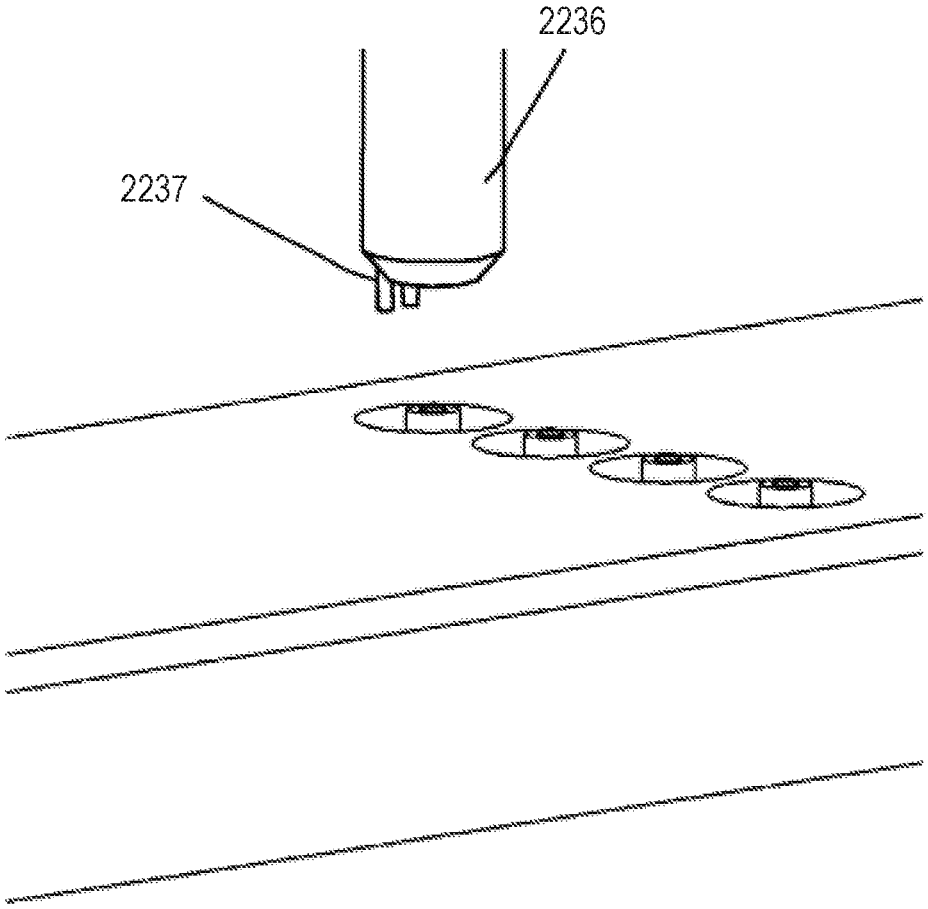
FIG. 13 is a perspective view of a liquid supply/recovery connector according to a variation.

Although in the present embodiment, the detection pins 2235 have been cited as an example of a detection unit, a detection unit other than the detection pins 2235 may be used as long as ink leakage can be detected. For example, the detection unit may be an optical one which uses an optical component such as a prism or float. Also, as with a variation shown in FIG. 13, detection pins 2237 may be provided on a pipe 2236 connected to each supply pipe 2231.

As the supply pipes 2231 are surrounded by the partition wall 2233, ink leakage from any of the supply pipes 2231 can be detected by a single leakage detection unit. Consequently, the present embodiment can downsize the liquid ejection head 3. Note that although in the present embodiment, four supply pipes 2231 (all the supply pipes) are surrounded by the partition wall 2233, the effect described above can be achieved as long as two or more supply pipes are surrounded.

Although the partition wall 2233 according to the present embodiment has been described as being a wall protruding from a plane (see FIG. 12B), the partition wall 2233 may be of any type as long as the ink that has leaked can be accumulated.

Figure 14:
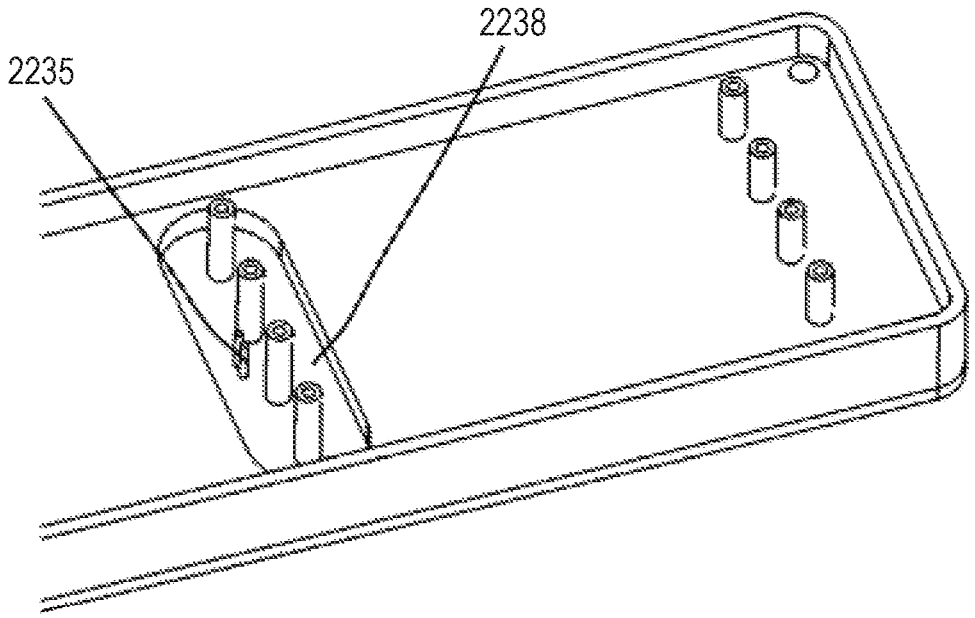
FIG. 14 is a perspective view of a liquid supply/recovery connector according to a variation.

For example, as with a variation shown in FIG. 14, all the supply pipes 2231 may protrude from a bottom face (plane) of a depression (recess 2238) with the roots 2234 of all the supply pipes 2231 being surrounded by an inner circumferential surface of the recess 2238. That is, the partition wall 2233 according to the present embodiment may be configured to be a closed wall protruding from the bottom face of the recess 2238, with all the roots 2234 being surrounded by the inner circumferential surface of the recess 2238. In this case, the detection pins 2235 can be provided on the bottom face of the recess 2238.

Figure 15:
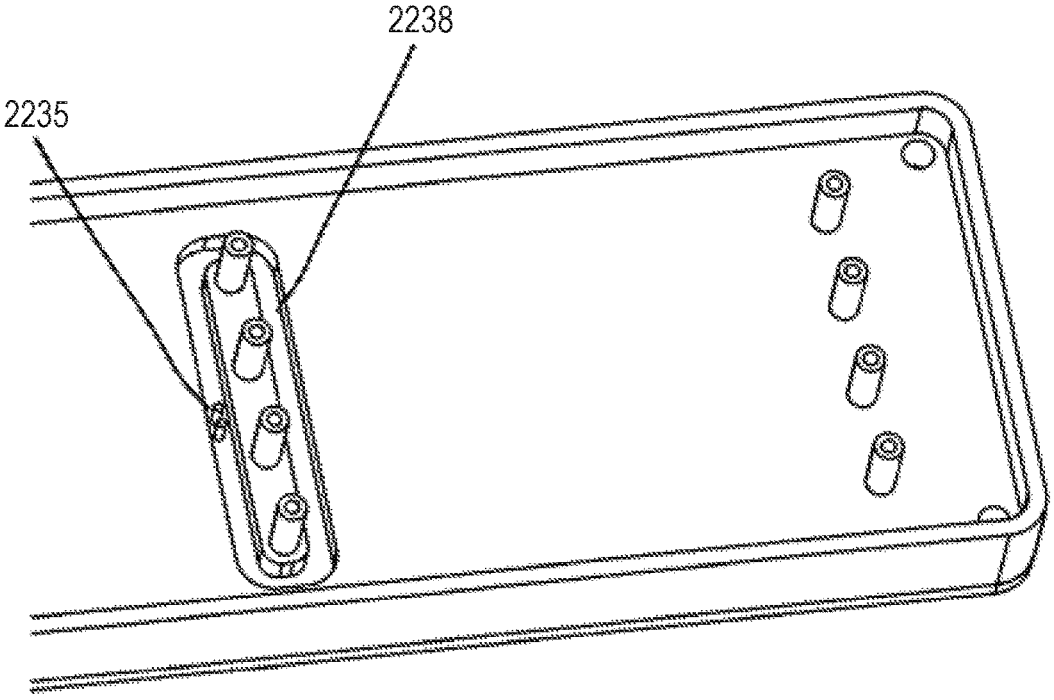
FIG. 15 is a perspective view of a liquid supply/recovery connector according to a variation.

Also, for example, as with a variation shown in FIG. 15, the plane from which all the supply pipes 2231 protrude may be surrounded by a recess 2238 with a closed circumference. In this case, the detection pins 2235 can be provided on the bottom face of the recess 2238 with a closed circumference.

The supply pipes 2231, the recovery pipes 2232, and electrical connector 94 have the following relationships. Here, the supply pipes 2231 are more liable to cause ink to leak outside than the recovery pipes 2232. Viewed from another angle, the recovery pipes 2232 are less liable to cause ink to leak outside than the supply pipes 2231. According to the present embodiment, the supply pipes 2231 (supply connectors 111) are located more distant from the electrical connector 94 than are the recovery pipes 2232 (recovery connectors 112).

With the above configuration, according to the present embodiment, the amount of ink leaking from the supply pipes 2231 and flying to the electrical connector 94 is smaller than when the supply pipes 2231 are located closer to the electrical connector 94 than are the recovery pipes 2232. As a result, the present embodiment provides high electrical reliability.

According to the present embodiment, the supply connectors 111 are placed closer to the negative pressure control units 230 than are the recovery connectors 112. Consequently, according to the present embodiment, the flow path length from the supply connectors 111 to the negative pressure control units 230 can be reduced compared to when the recovery connectors 112 are placed closer to the negative pressure control units 230 than are the supply connectors 111.

With the above configuration, the present embodiment can reduce waste ink by the amount corresponding to the reduction in the flow path length from the supply connectors 111 to the negative pressure control units 230.

The present disclosure has been described above by taking the above embodiment as an example, but the technical scope of the present disclosure is not limited to the present embodiment.

For example, whereas the present disclosure adopts, as an example, a thermal method which ejects ink by forming air bubbles using heat-generating elements, the present disclosure is also applicable to liquid ejection heads which adopt a piezo method or any of various other liquid ejection methods.

The liquid ejection head according to the present disclosure makes it easy to take measures against liquid leakage from a liquid supply connector and a liquid recovery connector provided on the liquid ejection head. Consequently, the present disclosure can keep the liquid ejection head and the liquid ejection apparatus body from growing in size.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-133994, filed Jul. 7, 2017, which is hereby incorporated by reference herein in its entirety.

What is claimed is:

1. A page-wide liquid ejection head detachable from a main body of a liquid ejection apparatus, the liquid ejection head comprising:

a plurality of supply connectors connected to the main body and adapted to allow passage of a liquid supplied to the liquid ejection head;

a recovery connector connected to the main body and adapted to allow passage of the liquid recovered from the liquid ejection head; and a peripheral wall configured to surround bases of the plurality of the supply connectors, wherein the supply connectors and the recovery connector are positioned at one end in a longitudinal direction of the liquid ejection head, and the plurality of the supply connectors protrude from a plane.

2. The liquid ejection head according to claim 1, further comprising a plurality of the recovery connectors, wherein the plurality of supply connectors are positioned close to each other and the plurality of recovery connectors are positioned close to each other.

3. The liquid ejection head according to claim 1, wherein the peripheral wall is a closed wall protruding from the plane, with an inner circumferential surface of the wall surrounding the bases.

4. The liquid ejection head according to claim 1, wherein:

the plane is a bottom face of a depression, and the peripheral wall includes a closed inner circumferential surface forming the depression and the inner circumferential surface surrounds the bases.

5. The liquid ejection head according to claim 1, wherein the plane is surrounded by a depression with a closed circumference.

6. The liquid ejection head according to claim 1, further comprising detection units adapted to detect liquid leakage inside the peripheral wall, wherein the detection units are fewer in number than the supply connectors.

7. The liquid ejection head according to claim 1, further comprising a pressure control unit adapted to adjust pressure of the liquid, wherein the supply connectors are positioned at a location closer to the pressure control unit than the recovery connector is to the pressure control unit.

8. The liquid ejection head according to claim 1, further comprising an electrical connection part to be electrically connected to the main body, wherein the supply connectors are positioned at a location more distant from the electrical connection part than the recovery connector is from the electrical connection part.

9. The liquid ejection head according to claim 1, further comprising a plurality of recording element substrates positioned in line and provided with ejection orifices adapted to eject the liquid.

10. The liquid ejection head according to claim 1, wherein the liquid ejection head is an integral head adapted to eject multi-color liquids.

11. The liquid ejection head according to claim 1, further comprising a pressure chamber containing a recording element adapted to generate energy, wherein the liquid in the pressure chamber is circulated into and out of the pressure chamber.

12. A liquid ejection apparatus comprising:

the liquid ejection head according to claim 1;

a main body in which the liquid ejection head is mounted; and a transport unit adapted to transport a recording medium to a position opposed to the liquid ejection head.

13. A page-wide liquid ejection head detachable from a main body of a liquid ejection apparatus, the liquid ejection head comprising:

a plurality of supply connectors connected to the main body and adapted to allow passage of a liquid supplied to the liquid ejection head; and a recovery connector connected to the main body and adapted to allow passage of the liquid recovered from the liquid ejection head, wherein the supply connectors and the recovery connector are positioned at one end in a longitudinal direction of the liquid ejection head, the plurality of the supply connectors protrude from a plane, and the plane is surrounded by a depression with a closed circumference.

14. The liquid ejection head according to claim 13, further comprising a plurality of the recovery connectors, wherein the plurality of supply connectors are positioned close to each other and the plurality of recovery connectors are positioned close to each other.

15. The liquid ejection head according to claim 13, further comprising a pressure control unit adapted to adjust pressure of the liquid, wherein the supply connectors are positioned at a location closer to the pressure control unit than the recovery connector is to the pressure control unit.

16. The liquid ejection head according to claim 13, further comprising an electrical connection part to be electrically connected to the main body, wherein the supply connectors are positioned at a location more distant from the electrical connection part than the recovery connector is from the electrical connection part.

17. The liquid ejection head according to claim 13, further comprising a plurality of recording element substrates positioned in line and provided with ejection orifices adapted to eject the liquid.

18. The liquid ejection head according to claim 13, wherein the liquid ejection head is an integral head adapted to eject multi-color liquids.

* * * * *